US005238190A

United States Patent [19]

Herke

[11] Patent Number: 5,238,190

[45] Date of Patent: Aug. 24, 1993

[54] OFFSET NOZZLE ASSEMBLY

[75] Inventor: Jeffrey J. Herke, Suwanee, Ga.

[73] Assignee: Nordson Corporation, Westlake, Ohio

[21] Appl. No.: 899,434

[22] Filed: Jun. 16, 1992

[51] Int. Cl.[5] ..... B05B 1/34; B05B 15/08

[52] U.S. Cl. ..... 239/298; 239/587.5; 118/302; 118/313; 156/494; 156/578

[58] Field of Search ..... 239/124, 298, 296, 290, 239/587.1-587.6, 406; 118/302, 313; 156/578, 494, 295, 291

[56] References Cited

U.S. PATENT DOCUMENTS

| | | | |
|---|---|---|---|
| Re. 27,865 | 1/1974 | Baker et al. . | |
| Re. 33,481 | 12/1990 | Ziecker | 239/298 |
| 721,746 | 3/1903 | Robinson | 239/587.5 |
| 1,961,481 | 6/1934 | Downs | 239/587.2 |
| 2,052,362 | 8/1936 | Roselund | 239/587.5 |
| 3,000,036 | 9/1961 | Benedetti | 239/587.5 |
| 3,421,702 | 1/1969 | O'Brien | 239/587.4 |
| 3,825,379 | 7/1974 | Lohkamp et al. . | |
| 3,911,173 | 10/1975 | Sprague, Jr. . | |
| 3,920,362 | 11/1975 | Bradt . | |
| 4,185,981 | 1/1980 | Ohsato et al. . | |
| 4,469,248 | 9/1984 | Petrecca | 239/288 |
| 4,815,660 | 3/1989 | Boger | 239/298 |
| 4,969,602 | 11/1990 | Scholl | 239/298 |
| 4,983,109 | 1/1991 | Miller et al. | 239/298 |
| 5,065,943 | 11/1991 | Boger et al. | 239/298 |
| 5,071,074 | 12/1991 | Lind | 239/587.5 |

FOREIGN PATENT DOCUMENTS 0909427 10/1962 United Kingdom .

*Primary Examiner*—Andres Kashnikow
*Assistant Examiner*—Karen B. Merritt
*Attorney, Agent, or Firm*—Wood, Herron & Evans

[57] ABSTRACT

A nozzle assembly, adapted to mount to the distribution manifold of a spray head attachment, comprises a nozzle body fixedly mounted to the distribution manifold, a nozzle attachment rotatably mounted to the nozzle body and a nozzle plate carried by the nozzle attachment which is formed with an adhesive discharge bore and a number of air jet bores The nozzle plate is mounted on the nozzle attachment in an offset position with respect to the longitudinal axis of the nozzle body, and, because the nozzle attachment is rotatably mounted to the nozzle body, the position of the discharge bore of the nozzle plate can be adjusted with respect to the nozzle body.

3 Claims, 2 Drawing Sheets

OFFSET NOZZLE ASSEMBLY

FIELD OF THE INVENTION

This invention relates to adhesive dispensers, and, more particularly, to a nozzle assembly capable of dispensing an elongated, thin strand or fiber of adhesive from a discharge outlet whose position is rotatably adjustable.

BACKGROUND OF THE INVENTION

Hot melt thermoplastic adhesives have been widely used in industry for adhering many types of products, and are particularly useful in applications where quick setting time is advantageous. One application in which hot melt adhesives has been widely used involves the dispensing of multiple, parallel beads of pressure sensitive hot melt adhesive onto the backing sheet of a disposable diaper so as to adhere the backing sheet to the non-woven, absorbent pad of a diaper. One apparatus commonly employed for this purpose is a metering gear head having a plurality of spaced discharge orifices, each supplied with adhesive from a gear pump, which are positioned relative to the backing sheet to apply parallel beads of adhesive thereto for subsequent attachment to a nonwoven absorbent pad. Metering gear heads provide for precise control of the quantity of adhesive dispensed, and accurately locate the adhesive beads on the backing sheet of the diaper so the resulting product has multiple adhesive beads of uniform size, width and spacing As discussed in detail in U.S. Pat. No. 4,983,109, owned by the assignee of this invention, metering gear heads employed in the manufacture of disposable diapers have a number of disadvantages including high application temperature of the adhesive, and the fact that a relatively high volume of adhesive is used to obtain the desired bond between the backing sheet and non-woven pad. The invention disclosed in the U.S. Pat. No. 4,983,109 patent overcomes these problems of metering gear heads by the provision of a spray head attachment adapted to mount directly to the manifold of conventional metering gear heads. The spray head attachment of the U.S. Pat. No. 4,983,109 patent comprises a distribution manifold formed with a number of adhesive connector passageways each connected to an outlet of the metering gear head manifold, a number of air passageways connected to a source of pressurized air and a number of recirculation passageways which communicate with a source of hot melt adhesive, or, alternatively, to the metering gear head manifold. All of these passageways terminate at a discharge surface of the distribution manifold and have orifices thereat arranged in arrays of three, i.e., an outlet of one adhesive passageway, an outlet of one air passageway and an inlet of one recirculation passageway are all located proximate one another in an array on the discharge surface of the distribution manifold.

A plurality of nozzles are mounted to this discharge surface of the distribution manifold so that one array of adhesive, air and recirculation passageway orifices are connected to each nozzle. One nozzle suitable for use with the distribution manifold is disclosed, for example, in U.S. Pat. No. RE 33,481 to Ziecker et al, owned by the assignee of this invention. Adhesive discharged from an adhesive passageway in the distribution manifold of the spray head attachment flows into each of these nozzles and is ejected as an adhesive bead from the discharge orifice of a nozzle plate carried by such nozzle. Each nozzle plate is formed with air jet bores connected via an air connector bore in the nozzle to one of the air passageways in the distribution manifold, and these air jet bores are effective to direct air jets at the periphery of the adhesive bead ejected from the nozzle plate to stretch the bead forming an elongated adhesive strand or fiber, and to impart a twisting motion to such fiber so that it is deposited in a controlled, spiral spray pattern upon the backing sheet of a hygienic article such as a disposable diaper. The spiral spray pattern of the adhesive strand has a low application temperature, compared to the beads discharged from a prior art metering gear head, and provides the desired bond strength between the backing sheet and non-woven pad of the disposable diaper using a relatively small quantity of adhesive.

In a commercial disposable diaper production line, conventional metering gear heads apply 32 or more individual, parallel beads of adhesive onto a moving backing sheet which is subsequently cut along both its width and length to form individual disposable diapers. The spray head attachment of U.S. Pat. No. 4,983,109 is constructed to directly mount to such metering gear heads and thus its distribution manifold is machined with 32 sets or arrays of adhesive, air and recirculation passageways located along the width of the manifold Thirty-two nozzles of the type described in U.S. Pat. No. RE 33,481 are fixed to the distribution manifold, one over each separate array of passageways, to produce 32 side-by-side or overlapping spiral patterns of an elongated adhesive fiber.

One problem with the spray head attachment of U.S. Pat. No. 4,983,109 is that the nozzles are fixedly mounted to the distribution manifold, and, therefore, the relative position of the spiral spray patterns cannot be altered. If a different spacing or orientation of the spiral spray patterns of elongated adhesive strands is desired, an entirely new distribution manifold for the spray head attachment of U.S. Pat. No. 4,983,109 must be constructed. Because of the large number of passageways which need to be machined in such manifold, and the accuracy required in the machining operation, the production of modified spray head attachments to accommodate a particular pattern arrangement is costly.

SUMMARY OF THE INVENTION

It is therefore among the objectives of this invention to provide a nozzle assembly for use with dispensing apparatus such as those employed to apply adhesive strands to the backing sheet of a hygienic article which provides for adjustment of the relative position of the adhesive pattern applied to the backing sheet.

These objectives are accomplished in a nozzle assembly adapted to mount to the distribution manifold of a spray head attachment of the type disclosed in U.S. Pat. No. 4,983,109, owned by the assignee of this invention, the disclosure of which is incorporated by reference in its entirety herein. The nozzle assembly comprises a nozzle body fixedly mounted to the distribution manifold, a nozzle attachment rotatably mounted to the nozzle body and a nozzle plate carried by the nozzle attachment which is formed with an adhesive discharge bore and a number of air jet bores. The nozzle plate is mounted on the nozzle attachment in an offset position with respect to the longitudinal axis of the nozzle body, and, because the nozzle attachment is rotatably mounted to the nozzle body, the position of the discharge bore of the nozzle plate can be adjusted with respect to the nozzle body.

As described in U.S. Pat. No. 4,983,109, the distribution manifold of the spray head attachment therein is formed with a plurality of adhesive passageways each connected to an outlet of the metering gear head, a plurality of air passageways connected to a source of pressurized air and a number of recirculation passageways which either communicate with a source of hot melt adhesive or, alternatively, the metering gear head manifold. These three types of passageways terminate at the discharge surface of the distribution manifold and are arranged thereat in groups or arrays of three, i.e., one array consists of the orifices of one adhesive, one air and one recirculation passageway.

The nozzle assembly of this invention is mounted to the discharge surface of the distribution manifold so that one array of adhesive, air and recirculation passageway orifices is connected to each nozzle assembly. The nozzle body of each nozzle assembly is directly mounted to the distribution manifold and is formed with an adhesive supply bore connected to the adhesive passageway in one array, and an air supply bore which is connected to the air passageway in such array. The nozzle attachment of each nozzle assembly is mounted to the nozzle body by connector means, described in detail below, in position such that an adhesive connector bore formed in the nozzle attachment is connected to the adhesive supply bore in the nozzle body and an air connector bore formed in the nozzle attachment is connected to the air supply bore in the nozzle body. The adhesive connector bore and air connector bore of the nozzle attachment parallel one another. Each bore includes an upper portion closest to the nozzle body, a lower portion parallel to and laterally offset from the upper portion, and, an intermediate portion interconnecting the upper and lower portions.

In the presently preferred embodiment, the connector means which mounts the nozzle attachment to the nozzle body permits rotational movement of the nozzle attachment, and, in turn, the nozzle plate, over substantially 360° relative to the nozzle body. Preferably, the lower, outer end of the nozzle body is threaded and mates with the internal threads of a nozzle nut The wall of the nozzle nut is formed with an internal, annular recess which is connected to a bore extending through the nozzle nut wall. The upper end of the nozzle attachment is insertable within the interior of the nozzle nut and is formed with an annular groove or slot which aligns with the recess in the nozzle nut. The nozzle nut and nozzle attachment are interconnected by inserting a locking wire through the hole in the nozzle nut and into the recess thereof so that the wire extends in between the recess of the nozzle nut and the slot of the nozzle attachment The nozzle nut and nozzle attachment are thus permanently interconnected by the locking wire, but the nozzle attachment is free to slidably rotate on the locking wire within the nozzle nut The nozzle attachment is mounted to the nozzle body by threading the nozzle nut onto the lower end of the nozzle body until the top of the nozzle attachment engages the base of the nozzle body. Before the nozzle nut is tightened down, the nozzle attachment can be rotated over 360° so that the discharge bore of the nozzle plate carried by the nozzle attachment can be moved to the desired position relative to the fixed nozzle body.

The nozzle plate employed with the nozzle assembly of this invention is fully described in Reissue Patent No. RE 33,481, the disclosure of which is incorporated by reference in its entirety herein. As discussed in that patent, the nozzle plate is a one-piece annular plate which is mounted by a cap to the base of the nozzle attachment. The nozzle plate is formed with a discharge bore adapted to connect to the adhesive connector bore in the nozzle attachment, and a plurality of spaced air jet bores which communicate with an air cavity formed in the back of the nozzle attachment which connects to the air connector bore. Adhesive transmitted through the nozzle body and nozzle attachment is ejected as a bead from the discharge bore in the nozzle plate and this bead is impacted by air jets discharged from the spaced air jet bores therein. The air jets are directed tangentially relative to the adhesive bead to both stretch the bead forming an elongated hot melt adhesive fiber, and to impart a twisting, rotating motion to the adhesive fiber so that it is deposited in a controlled spiral spray pattern upon the backing sheet. Thirty-two overlapping patterns of hot melt adhesive fibers, one from each of thirty-two nozzle assemblies carried by the distribution manifold, can be applied to the backing sheet of a hygienic article such as a disposable diaper by the adhesive dispensing system disclosed in U.S. Pat. No. 4,983,109. An important advantage provided by the spray nozzle of this invention is that the position of each of these adhesive patterns can be adjusted, by rotating the nozzle attachment and nozzle plate relative to the nozzle body, as required.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
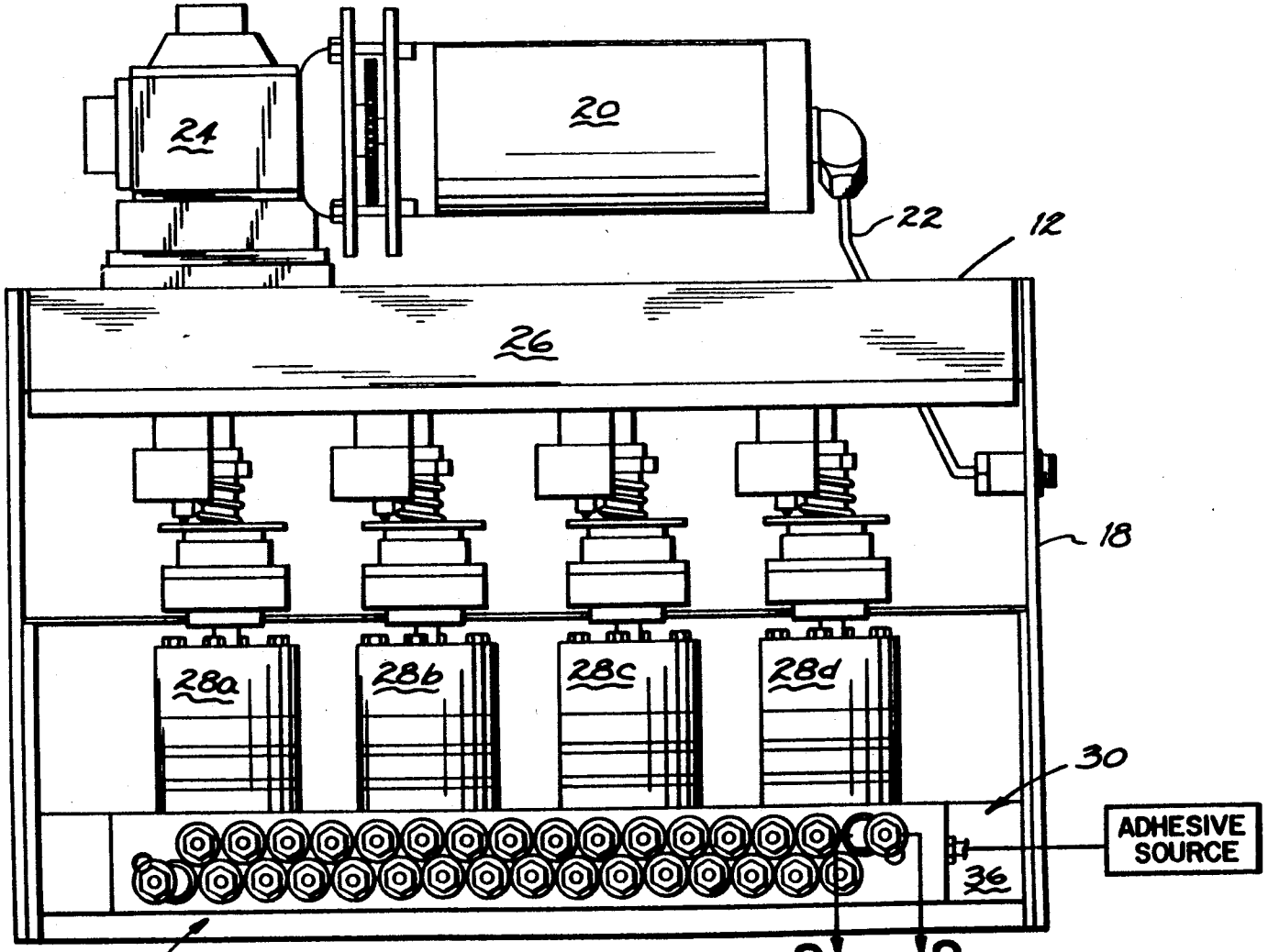
FIG. 1 is a bottom view of a metering gear head and spray head attachment to which a number of nozzle assemblies described below can be mounted.

Referring now to FIG. 1, a hot melt adhesive dispensing system 10 is illustrated. The detailed construction of the dispensing system 10 forms no part of this invention, and is thus described briefly herein for purposes of illustrating a system with which the nozzle assembly of this invention can be utilized. The system 10 comprises a flow metering device such as a metering gear head 12 and a spray head attachment 14 mounted to the metering gear head 12. The dispensing system 10 is operative to discharge a plurality of patterns of hot melt adhesive, preferably in the form of elongated strands or fibers, onto the surface of a substrate such as the backing sheet used in the formation of hygienic articles including disposable diapers. See schematic depiction of one adhesive fiber or strand 15 in FIG. 2.

The metering gear head 12 is commercially available and is of the general type used in the production of disposable diapers. The metering gear head 12 comprises a housing 18 having a top surface which mounts an electric motor 20 connected to an electric cable 22, and a gear reducer 24 which is drivingly connected to the output of motor 20. The output of the gear reducer 24 is connected to a transmission 26 which extends across the top of the housing 18 between its opposed sides. The transmission 26 is drivingly connected to four gear pumps 28*a–d* which are located in the interior of the housing 18.

Figure 2:
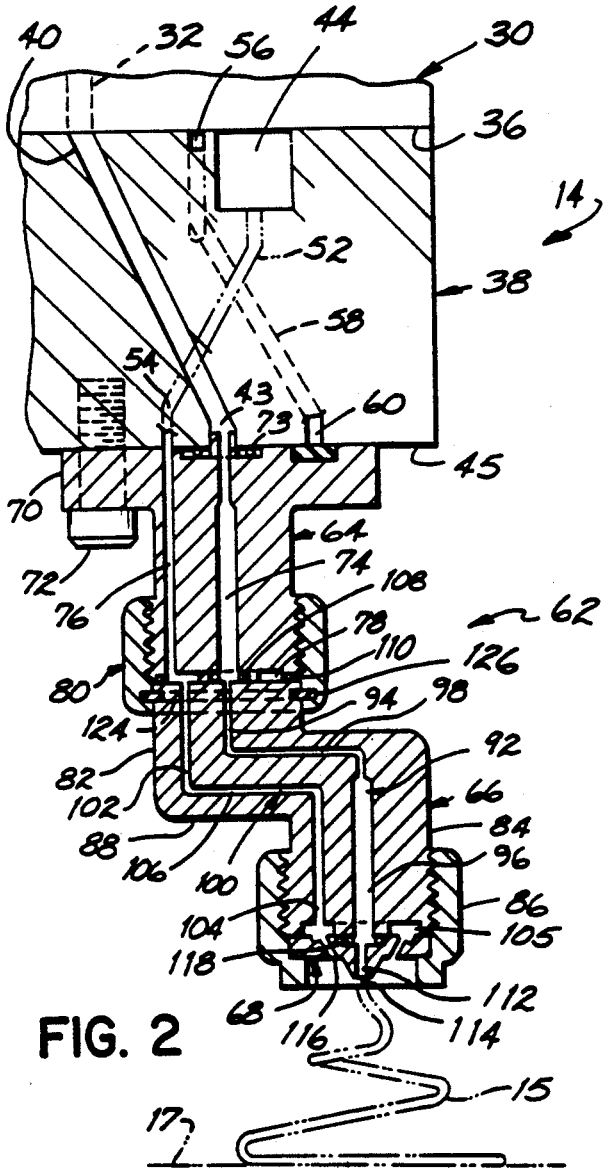
FIG. 2 is a cross sectional view of a portion of the manifold of the spray head attachment, and one of the nozzle assemblies herein, taken generally along line 2—2 of FIG. 1.

The gear pumps 23*a–d* are mounted to a manifold 30 carried at the base of the housing 18. As described in detail in U.S. Pat. No. 4,983,109, the output of each gear pump 28*a–d* is connected to the inlet of eight individual, adhesive supply passageways 32, one of which is shown in FIG. 2, which are formed in the manifold 30. Each gear pump 28*a–d* is operative to pump precise quantities of hot melt adhesive into each of the adhesive supply passageways 32 for discharge through their outlets formed on an outer surface face 36 of manifold 30. The gear pumps 28*a–d* each feed a group of eight adhesive supply passageways so that a total of 32 individual adhesive supply passageways 32 are formed in manifold 30, each having an outlet on its outer surface 36.

The spray head attachment 14 carried by the metering gear head 12, which is disclosed in U.S. Pat. No. 4,983,109, has a distribution manifold 38 which is mounted directly to the outer surface 36 of the manifold 30. The distribution manifold 38 is formed with a separate adhesive supply bore 40 connected to each of the adhesive supply passageways 32 in the manifold 30. Each of these adhesive supply bores 40 has an outlet 43 which terminates at a discharge surface 45 of the distribution manifold 38. The distribution manifold 38 is also formed with a continuous air channel 44, a portion of which is shown in FIG. 2, which extends longitudinally therealong. This air channel 44 receives pressurized air from a source (not shown) and transmits such pressurized air to each of a total of 32 air connector bores 52 formed in the distribution manifold 38, only one of which is shown in FIG. 2. The air connector bores 52 extend from the air channel 44 to the discharge surface 45 of distribution manifold 38 where each terminates in an outlet 54.

The distribution manifold 38 is also formed with a continuous recirculation channel 56, a portion of which is shown in FIG. 2. As described in U.S. Pat. No. 4,983,109, the recirculation channel 56 is connected to a total of 32 recirculation bores 58 formed in the distribution manifold 38, one of which is shown in FIG. 2, each of which extends to the discharge surface 45 of manifold 38 terminating at an inlet 60. Accordingly, as illustrated in FIG. 2, an adhesive connector bore 40, air connector bore 52 and recirculation bore 58 formed in the distribution manifold 38 have their outlets 43, 54 and inlet 60, respectively, located in an array of three on the discharge surface 45 of distribution manifold 38. That is, the outlet 43 of one adhesive connector passageway 40, the outlet 54 of one air connector passageway 52 and the inlet 60 of one recirculation passageway 58 are formed in close proximity to one another, in 32 separate arrays (one of which is shown in FIG. 2), along the longitudinal extent of the distribution manifold 38 at its discharge surface 45. One nozzle assembly 62 of this invention mounts over each of these arrays 43, 54 and 60 so that in the adhesive dispensing system 10 illustrated in FIG. 1 there are a total of 32 nozzle assemblies 62 available for use.

Referring now to the bottom of FIG. 2, the nozzle assembly 62 of this invention is illustrated in detail. The nozzle assembly 62 comprises a nozzle body 64, a nozzle attachment 66 and a nozzle plate 68. The nozzle body 64 is formed with an annular flange 70 which rests directly against the discharge surface 45 of manifold 38 over one array of the outlet 43 of an adhesive connector passageway 40, the outlet 54 of an air connector passageway 52 and the inlet 60 of a recirculation passageway 58. Preferably, the nozzle body 64 is fixedly mounted to the manifold 38 by mounting screws 72 extending through flange 70, one of which is shown in FIG. 2. The nozzle body 64 is formed with an adhesive supply bore 74 having an inlet connected to the outlet 43 of adhesive connector passage 40, and an outlet at the base of nozzle body 64. An O-ring 73 is located at the interface between the manifold 38 and nozzle body 64, within a recess which is concentric to the inlet to adhesive supply bore 74, to create a seal thereat. The nozzle body 64 is also formed with an air supply bore 76 which extends from the outlet 54 of air connector passage 52 in manifold 38 to an annular cavity 78 formed at the base of nozzle body 64. As illustrated in FIG. 2, the lower end of the outer surface of nozzle body 64 is formed with threads for mounting a nozzle nut 80 which is described in more detail below. For purposes of the present discussion, the terms "upper" or "top" are meant to refer to the top of the nozzle assembly 62 as it is depicted in FIG. 2, whereas the terms "bottom", "base" and/or "lower" refer to the opposite direction.

The nozzle attachment 66 has an upper portion 82 mounted to the nozzle body 64 by nozzle nut 80, a lower portion 84 which mounts the nozzle plate 68 via a cap 86, and, a middle portion 88 extending between the upper and lower portions 82, 84. As viewed in FIG. 2, the upper and lower portions 82, 84 are generally parallel, but offset from one another by the length of the middle portion 88. As described in more detail below, this offset allows the adhesive fiber 15 discharged from nozzle plate 68 to be deposited at a location off-set from the longitudinal axis or adhesive supply bore 74 of the nozzle body 64.

The nozzle attachment 66 is formed with an adhesive connector bore 92 having a vertically oriented upper section 94 located within the upper portion 82 of nozzle attachment 66, a vertically oriented lower section 96 located within the lower portion 84 of nozzle attachment 66 and a horizontally extending intermediate section 98 interconnecting the upper and lower sections 94, 96. Preferably, the diameter of the lower section 96 of adhesive connector bore 92 is greater than that of the upper and intermediate sections 94, 98, thereof. The nozzle attachment 66 is also formed with an air connector bore 00 which parallels the adhesive connector bore 92 and includes an upper section 102, a lower section 104 and an intermediate section 106 therebetween. As shown in FIG. 2, the lower section 104 of air connector bore 100 terminates at an air cavity 105 formed at the base of nozzle attachment 66. The upper section 94 of adhesive connector bore 92 is connected to the outlet of adhesive supply bore 74, and an 0-ring 108 is positioned in the upper portion 82 of nozzle attachment 66 at its interface with the nozzle body 64. Similarly, the upper section 102 of air connector bore 100 is connected to the annular cavity 78 of air supply bore 76 with an 0-ring 110 positioned around the periphery of nozzle attachment 66 facing the nozzle body 64.

As mentioned above, the nozzle plate 68 is of the type described in U.S. Pat. No. RE 33,481, the disclosure of which is incorporated by reference in its entirety herein. For purposes of the present discussion, the nozzle plate 68 includes a throughbore 112 having an inlet end connected to the lower section 96 of adhesive connector bore 92 and a discharge outlet 114 which emits an adhesive bead. The nozzle plate 68 is also formed with six air jet bores 116, two of which are shown in FIG. 2, each having an inlet end connected to the air cavity 105 formed at the base of nozzle attachment 66. Preferably, an 0-ring 118 is located at the connection between the lower portion 96 of adhesive connector bore 92 and the throughbore 112 of nozzle plate 68 to create a seal between the adhesive flowing into the throughbore 112 of nozzle plate 68 and the pressurized air entering the air jet bores 116 thereof.

As described in detail in Reissue Patent RE 33,481, a bead of adhesive is ejected from the discharge outlet 114 of nozzle plate 68 which is then impacted by jets of air from the air jet bores 116. The air jets tangentially impact the adhesive bead to both stretch the bead forming the elongated hot melt adhesive fiber 15, and to impart a twisting, rotating motion to the adhesive fiber 15 so that it is deposited in a controlled, spiral spray pattern on a substrate 17 such as the backing sheet of a disposable diaper. See FIG. 2

Figure 4:
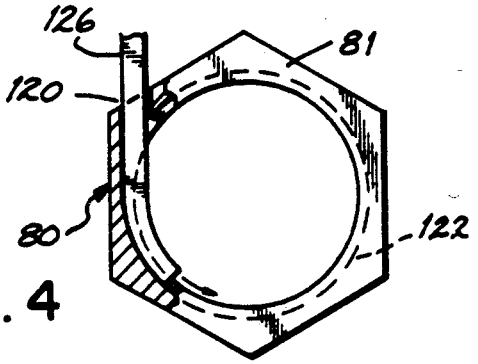
FIG. 4 is a plan view of the nozzle nut and locking wire used to interconnect the nozzle body and nozzle attachment.

One important feature of this invention is the connection between the nozzle body 64 and nozzle attachment 66 which permits the nozzle attachment 66, and, in turn, the nozzle plate 68, to be rotated over 360° with respect to the fixed nozzle body 64. As mentioned above, the nozzle body 64 and nozzle attachment 66 are interconnected by a nozzle nut 80. As viewed in FIG. 4, the wall 81 of nozzle nut 80 is formed with an access bore 120 which extends from its outer surface to an interior, annular recess 122 which extends inwardly from the inner wall surface of the nozzle nut 80. This annular recess 122 aligns with an annular groove 124 formed in the upper portion 82 of nozzle attachment 66 when the nozzle attachment 66 is placed inside of the nozzle nut 80. See FIG. 2. With the annular recess 122 and annular groove 124 in alignment, a locking wire 126 is inserted through the access bore 120 in nozzle nut 80 and into both the annular recess 122 and annular groove 124. The locking wire 126 is forced along the entire circumferences of the recess 122 and groove 124 so that the nozzle nut 80 and nozzle attachment 66 are essentially permanently interconnected. With the nozzle nut 80 and nozzle attachment 66 mounted together in this fashion, the nozzle nut 80 is then threaded onto the threaded portion of nozzle body 64 as shown in FIG. 2. The O-ring 110 at the periphery of nozzle attachment 66 prevents leakage of air from air supply bore 76 past the gap left by the locking wire 126 extending between the nozzle nut 80 and nozzle attachment 66 Before tightening down the nozzle nut 80, the nozzle attachment 66 is slidably rotated on the locking wire 126 to any position over a range of 360°, so that the discharge outlet 114 of the nozzle plate 68 carried by the nozzle attachment 66 can be located as desired with respect to the fixed nozzle body 64. When the desired position of the nozzle plate 68 is obtained, the nozzle nut 80 is tightened down to force the nozzle attachment 66 against the nozzle body 64. This mounting arrangement therefore permits essentially infinite adjustment of the nozzle attachment 66 and discharge outlet 114 of nozzle plate 68 along a 360° path relative to the fixed nozzle body 64.

Figure 3:
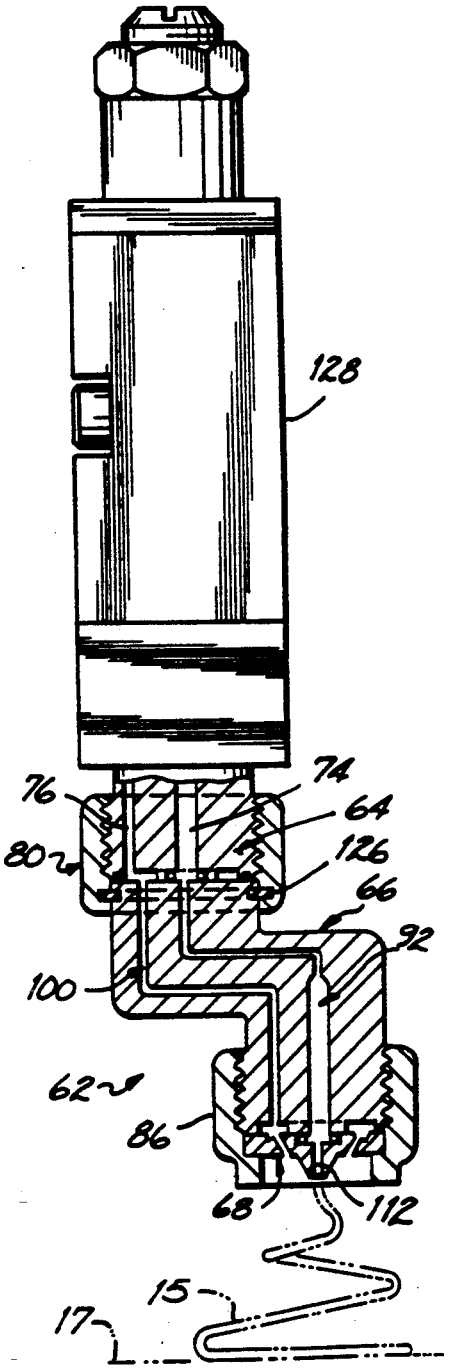
FIG. 3 is a view of the nozzle assembly shown in FIG. 2 mounted to an adhesive dispenser.

With reference to FIG. 3, the nozzle assembly 62 of this invention is schematically illustrated in combination with a dispensing apparatus of the type disclosed in U.S. Pat. No. RE 33,481. The detailed structure of adhesive dispenser 128 forms no part of this invention and is not described herein. FIG. 3 is provided to illustrate that the nozzle assembly 62 of this invention can also be adapted for use with a single adhesive dispenser as well as the adhesive dispensing system 10 illustrated in FIG. 1 and described in U.S. Pat. No. 4,983,109.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the rotatable connection between the nozzle attachment 66 and nozzle nut 80 is illustrated in the FIGS. as including a locking wire 126 insertable through an access bore 120 in the nozzle nut 80. It should be understood that this is but one example of a rotatable connection between the nozzle body 64 and nozzle attachment 66, and other connections could be utilized such as a compression snap-ring or the like.

Therefore, it is intended that the invention not be limited to the particular embodiment disclosed as the best mode contemplated for carrying out this invention, but that the invention will include all embodiments falling within the scope of the appended claims.

I claim:

1. A nozzle assembly for dispensing an elongated adhesive fiber in a spiral pattern onto a substrate, comprising:

a nozzle body having an adhesive supply bore adapted to communicate with a source of adhesive, and an air supply bore adapted to communicate with a source of pressurized air;

said nozzle body also having an end provided with threads;

a nozzle attachment formed with an adhesive connector bore having an inlet connected to said adhesive supply bore and an outlet, said nozzle attachment being formed with an air connector bore having an inlet connected to said air supply bore and an outlet;

said nozzle attachment having a radially inwardly extending annular slot;

a nozzle plate mounted to said nozzle attachment, said nozzle plate being formed with a throughbore connected to said outlet of said adhesive connector bore of said nozzle attachment for discharging a bead of adhesive, said nozzle plate being formed with air jet bores connected to said outlet of said air connector bore of said nozzle attachment for directing pressurized air substantially tangent to the outer periphery of said bead of adhesive to form an elongated adhesive fiber and to impart a twisting motion to said elongated adhesive fiber for deposition in a spiral spray pattern onto a substrate;

connector means for adjustably mounting said nozzle attachment to said nozzle body so that said throughbore of said nozzle plate is laterally offset relative to said adhesive supply bore and rotatably adjustable relative thereto; and wherein said connector means comprises:

a nozzle nut engageable with said threaded end of said nozzle body, said nozzle nut having a wall formed with an internal, annular recess which is alignable with said annular slot formed in said nozzle attachment; and locking means, insertable between said annular recess of said nozzle nut and said slot of said nozzle attachment, for rotatably mounting said nozzle attachment to said nozzle body.

2. The nozzle assembly of claim 1 in which said nozzle nut wall is formed with a bore connected to said internal, annular recess, said locking means comprising a locking wire insertable through said bore in said nozzle nut wall into said internal, annular recess and said annular slot.

3. Apparatus for spraying hot melt adhesive onto the backing sheet of a hygienic article, comprising:

a flow metering device having means for discharging a separately metered quantity of hot melt adhesive through each of a plurality of outlets;

a manifold mounted to said flow metering device, said manifold being formed with at least one adhesive connector passageway having an inlet communication with one of said outlets of said flow metering device and an outlet formed on a discharge surface of said manifold, said manifold being formed with at least one air connector passageway having an inlet adapted to connect to a source of pressurized air and an outlet formed on said discharge surface of said manifold, said outlet of said at least one adhesive connector passageway and said outlet of said at least one air connector passageway being arranged in an array of outlets on said discharge surface of said manifold consisting of an outlet of said at least one adhesive connector passageway and an outlet of said at least one air connector passageway;

a nozzle assembly mounted to said discharge surface of said manifold over said array of said at least one adhesive connector passageway outlet and said at least one air connector passageway outlet, said nozzle assembly comprising:

(i) a nozzle body formed with an adhesive supply bore connected to said at least one adhesive connector passageway, and an air supply bore connected to said at lest one air connector passageway, said nozzle body having an end provided with threads;

(ii) a nozzle attachment formed with an adhesive connector bore having an inlet connected to said adhesive supply bore and an outlet, said nozzle attachment being formed with an air connector bore having an inlet connected to said air supply bore an outlet, said nozzle attachment having a radially inwardly extending annular slot;

iii) a nozzle plate mounted to said nozzle attachment, said nozzle plate being formed with a throughbore connected to said outlet of said adhesive connector bore of said nozzle attachment for discharging a bead of adhesive, said nozzle plate being formed with air jet bores connected to said outlet of said air connector bore of said nozzle attachment for directing pressurized air substantially tangent to the outer periphery of said bead of adhesive to form an elongated adhesive fiber and to impart a twisting motion to said elongated adhesive fiber for deposition in a spiral spray pattern onto a substrate;

(iv) connector means for adjustably mounting said nozzle attachment to said nozzle body so that said throughbore of said nozzle plate is laterally offset relative to said adhesive supply bore and rotatably adjustable relative thereto, wherein said connector means comprises:

a nozzle nut engageable with said threaded end of said nozzle body, said nozzle nut having a wall formed with an internal, annular recess which is alignable with said annular slot formed in said nozzle attachment;

locking means, insertable between said annular recess of said nozzle nut and said slot of said nozzle attachment, for rotatably mounting said nozzle attachment to said nozzle body.

* * * * *

UNITED STATES PATENT AND TRADEMARK OFFICE

CERTIFICATE OF CORRECTION

PATENT NO. : 5,238,190

DATED : August 24, 1993

INVENTOR(S) : Jeffrey J. Herke

It is certified that error appears in the above-identified patent and that said Letters Patent is hereby corrected as shown below:

Column 5, line 13, "23a-d" should be -- 28a-d --.

Column 6, line 57, "00" shoud be -- 100 --.

Column 9, line 26, "communication" should be --communicating--.

Column 10, line 6, "lest" should be -- least --.

Column 10, line 14, before "an" insert the word -- and --.

Signed and Sealed this

Twenty-seventh Day of December, 1994

*Attest:*

Bruce Lehman

BRUCE LEHMAN

*Attesting Officer*

*Commissioner of Patents and Trademarks*